United States Patent [19]

Yoshieda et al.

[11] 4,262,569

[45] Apr. 21, 1981

[54] APPARATUS FOR THE FABRICATION OF A SLIDE FASTENER CHAIN WITH REINFORCEMENT TAPES

[75] Inventors: Keiichi Yoshieda, Kurobe; Kazuki Kuse, Toyama, both of Japan

[73] Assignee: Yoshida Kogyo K. K., Tokyo, Japan

[21] Appl. No.: 973,434

[22] Filed: Dec. 26, 1978

[30] Foreign Application Priority Data

Dec. 30, 1977 [JP] Japan ..... 52-160360

[51] Int. Cl.[3] ..... B26D 7/02

[52] U.S. Cl. ..... 83/386; 83/251; 83/39; 83/436; 83/921; 29/770; 29/408; 83/282; 83/465; 83/418

[58] Field of Search ..... 83/921, 39, 386, 436, 83/251, 465, 282, 418; 29/770, 408, 766

[56] References Cited

U.S. PATENT DOCUMENTS

| | | | |
|---|---|---|---|
| 2,754,908 | 7/1956 | Proud | 83/921 X |
| 3,063,323 | 11/1962 | Graf | 83/921 X |
| 3,376,772 | 4/1968 | Langwell | 83/921 X |
| 3,831,474 | 8/1974 | Perlman | 83/921 X |
| 3,848,500 | 11/1974 | Takahashi | 83/251 X |

*Primary Examiner*—Donald R. Schran

*Attorney, Agent, or Firm*—Hill, Van Santen, Steadman, Chiara & Simpson

[57] ABSTRACT

A method is provided for fabricating a slide fastener chain having a certain length and reinforcement tapes at its ends from a manufactured, continuous length fastener chain which is provided with space sections each of which entirely consists of a reinforced tape. According to the method, the original length fastener chain is held first by a pair of pressers on a die at one side of the main crosswise cutting line, then by another pair of pressers at the other side to form a right position so that the reinforced space section is cut along the crosswise line and at the same time, the lengthwise lines by a cutter blade. This method is performed using an apparatus with a linkage motion of its individual parts whereby working efficiency is improved and a good cutting finish is obtained.

3 Claims, 15 Drawing Figures

APPARATUS FOR THE FABRICATION OF A SLIDE FASTENER CHAIN WITH REINFORCEMENT TAPES

BACKGROUND OF THE INVENTION

The present invention relates to a method for the fabrication of a slide fastener chain with reinforcement tapes at the ends thereof and an apparatus therefor. In particular, the present invention relates to a method and an apparatus, in the manufacturing process of a slide fastener with a separable end stop, for cutting a slide fastener chain of continuous length with reinforcement tapes at individual space sections into individual slide fastener chains of definite product length having reinforcement tapes at the ends thereof bonded thereto together with removal of extraneous portions of the reinforcement tape.

Many slide fasteners with a separable end stop are provided with reinforcement tapes at both ends thereof. Such reinforcement tapes are made of a thermoplastic film or sheet and adhesively bonded to the space sections of a continuous length slide fastener chain where the carrier tapes have no interlocking elements fastened thereto and the slide fastener of continuous length is subsequently cut at the space sections together with the reinforcement tape into the product length whereby slide fasteners with reinforcement tapes at both ends thereof are obtained. In addition to cutting off of the carrier tapes per se, the extraneous portions of the reinforcement tape out of the edges of the carrier tapes must be removed by cutting.

In the prior art, no convenient and exact method or apparatus is known for the fabrication of the above described slide fasteners with reinforcement tapes at the ends thereof. For example, an apparatus is described in Japanese Patent Publication No. 39-17044 according to which the adhesive bonding of the reinforcement tapes to the fastener chain is simultaneously performed with cutting off of the extraneous portions of the reinforcement tapes but the cutting of the fastener chain into individual product length must be carried out separately following the above mentioned bonding of the reinforcement tapes and cutting off of the extraneous portions of the reinforcement tapes resulting in two-step cutting with decreased productivity and also with inexactness of cutting since the fastener chain is not under tension at the moment of cutting.

SUMMARY OF THE INVENTION

The object of the present invention is therefore to provide a convenient method for the fabrication of a slide fastener chain with reinforcement tapes at the ends thereof and an apparatus therefor.

The method of the present invention comprises:

(a) a step of placing a fastener chain with a reinforcement tape adhesively bonded to the space section thereof on a die, (b) a step of process-holding the fastener chain at a side of the cutting line thereof on to the die, (c) a step of positioning the press-held fastener chain by sliding while thus being pressed down, (d) a step of press-holding the fastener chain at the other side of the cutting line thereof on to the die, and (e) a step of cutting the fastener chain on the die along the cutting line together with extraneous portions of the reinforcement tape bonded thereto.

The apparatus of the present invention designed for practicing the above method for the fabrication of a slide fastener chain with reinforcement tapes at the ends thereof is essentially composed of:

(1) a die, (2) two guide plates for the fastener chain each with a protruded guide rail on the upper surface thereof positioned in the front and at the rear of the die running in the direction of the center line of the die, (3) a vertically movable cutter blade positioned above the die, (4) a first presser positioned at the rear of the cutter blade and engaged by an engagement means with downward enforcement with a first spring, and (5) a second presser with free vertical movement positioned in the front of the cutter blade with downward enforcement with a second spring.

DETAILED DESCRIPTION OF THE PREFERRED EMBODIMENTS

The method and apparatus of the present invention are now illustrated in detail by way of example with reference to the drawings annexed.

Figure 1:
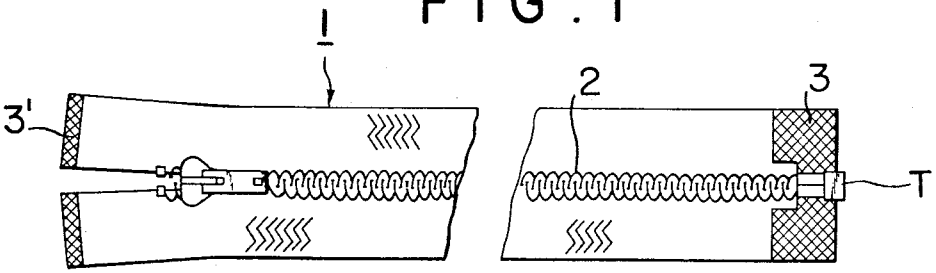
FIG. 1 is a plan view of a slide fastener with a separable end stop and a slider finished in accordance with the method of the invention to provide the reinforcement tapes at both ends thereof.

The objective product of the present invention is a slide fastener 1 as illustrated in FIG. 1 in which reinforcement tapes 3,3' are adhesively bonded to the ends of both carrier tapes of a product length as interengaged with each other at the rows of the interlocking elements 2 with a slider mounted thereon and provided with a separable end stop T enabling the slide fastener to be severed into two separate stringers at the end.

Figure 2:
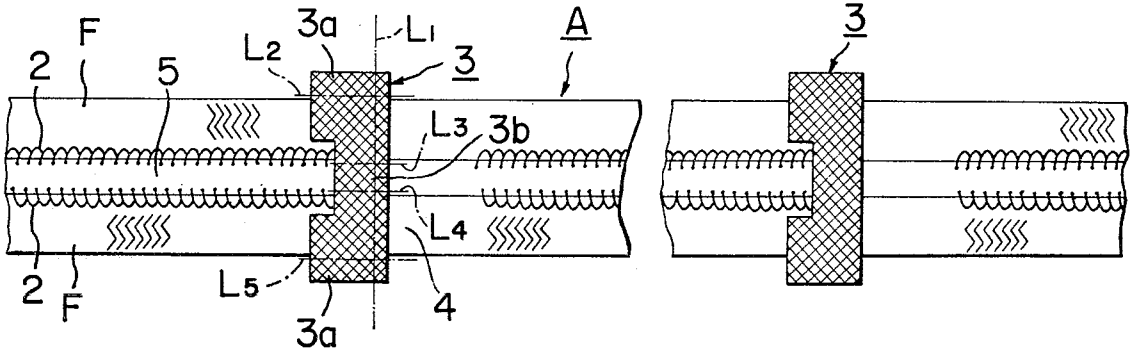
FIG. 2 is a plan view of a continuous length fastener chain with reinforcement tapes attached to the space sections before fabrication according to the invention.

The reinforcement tapes 3 made of a thermoplastic resin film or sheet are provided at the lower ear ends of the carrier tapes following the rows of the elements 2 by adhesively bonding in order to impart rigidity to the slide fastener. Such a slide fastener with reinforcement tapes is manufactured by first adhesively bonding pieces of a plastic film 3 on to the individual space sections of a pair of continuous length fastener stringers F to form a continuous length fastener chain A as shown in FIG. 2 with reinforcement tapes 3 at intervals and then cutting it along the main cutting line $L_1$ into individual product length with simultaneous cutting off of the extraneous portions of the reinforcement tapes 3*a*, 3*b* along the auxiliary cutting lines $L_2$ to $L_5$ followed by assembling of the thus obtained fastener chains of product length by mounting a slider, an upper end stop and a separable end stop at the lower end. Thus cutting work should be performed not only along the main cutting line $L_1$ but also along the auxiliary cutting lines $L_2$ to $L_5$ as is shown in FIG. 2 to cut off the extraneous portions of the reinforcement tape 3 at both sides 3*a*, 3*a* and at the center 3*b* simultaneously.

Figure 3:
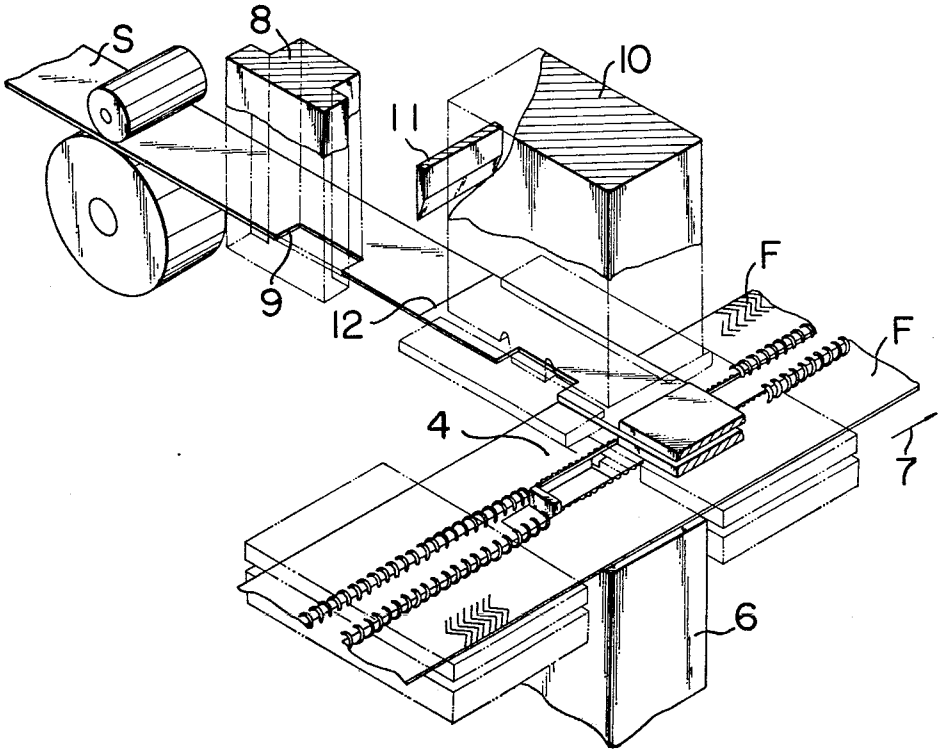
FIG. 3 is a perspective view for illustrating a typical process of preparing the continuous length fastener chain of FIG. 2.

An exemplary process for preparing the continuous length fastener chain A with reinforcement tapes 3 shown in FIG. 2 is illustrated in FIG. 3, in which a pair of continuous length fastener chains F, F provided with space sections 4 in advance are transferred on the die 6 in the direction shown by the arrow 7 and become settled at an exact position to place a space section 4 on the die 6. In parallel with the above movement of the fastener chains F, a continuous length plastic tape S, in which notched sections 9 are formed at one side thereof by cutting with a punch 8, is fed on to the fastener chains F intersecting at a right angle so as that the notched section 9 is just on the spaced section 4 of the fastener chains F on the die, where a hot punch 10 is lowered to adhesively bond with heat the tape S to the space section 4 of the fastener chains F to be a reinforcement tape 3 followed by cutting of the tape S along the cutting line 12 with a cutter blade 11 to give a continuous length fastener chain A with reinforcement tapes 3 at intervals on the spaced sections 4 by repeating the above procedure.

Figure 4:
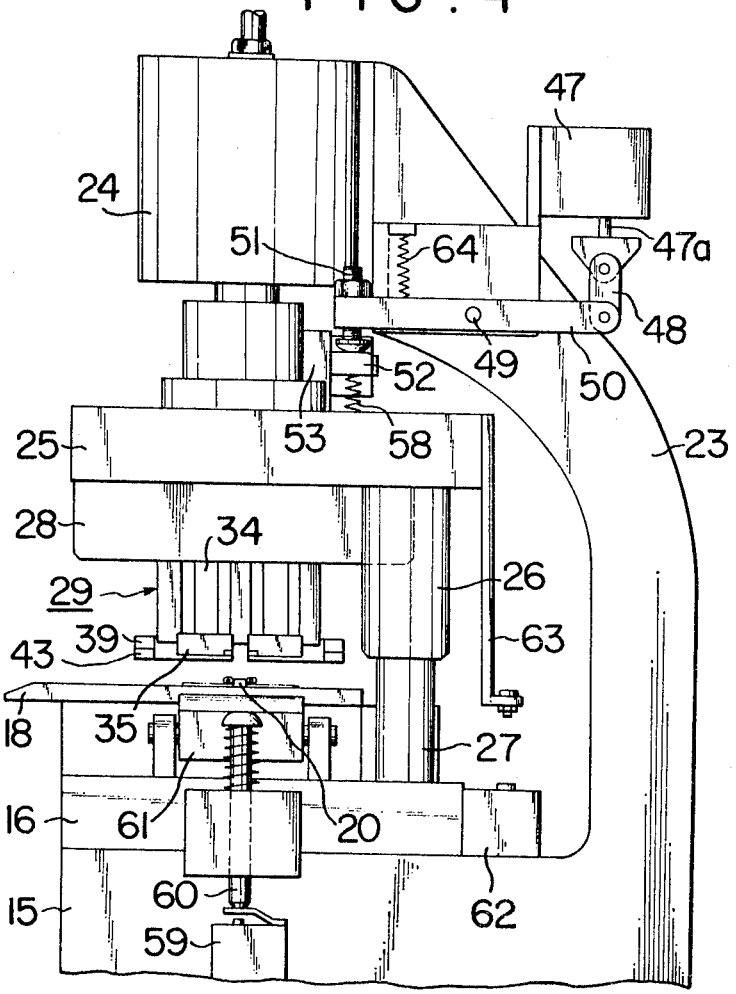
FIG. 4 is an elevational side view of apparatus embodying the invention.
Figure 5:
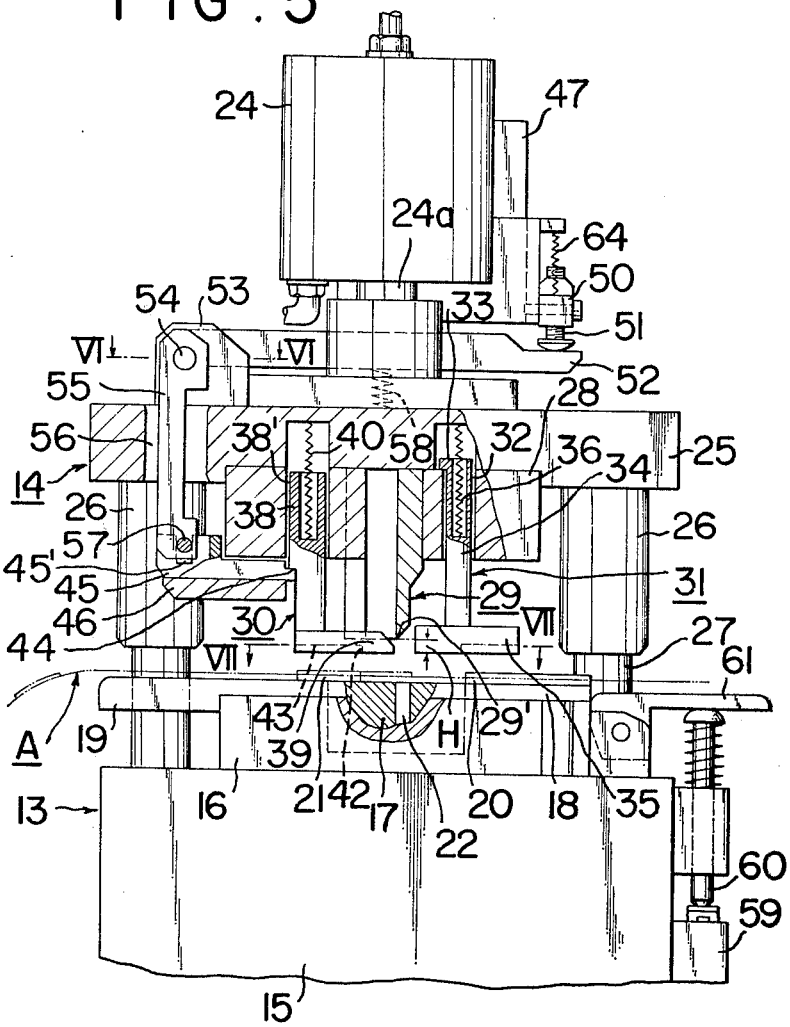
FIG. 5 is an elevational front view of the apparatus of FIG. 4 as partially cut in the main part thereof.
Figure 6:
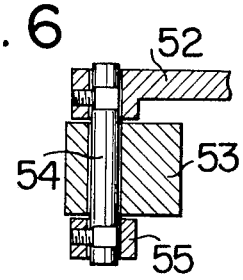
FIG. 6 is a cross sectional view of the apparatus of FIG. 5 along the line VI—VI.

In FIGS. 4 and 5 illustrating the apparatus embodying the present invention, 13 is a die unit and 14 is a punching unit and the die unit 13 is provided with a base 15, a die plate 16 on the base 15 and a die 17 protruding above the die plate 16 as partly embedded in the die plate 16. To the die plate 16 are integrally fixed two chain-guide plates 18, 19 at the forward position, i.e. to the right in FIG. 5, and at the rearward position, i.e. to the left in FIG. 5, respectively, having the top surfaces at the same coplanar level with the upper surface of the die 17 forming a plane. These chain-guide plates 18, 19 respectively have a linear protrusion or guide 20, 21, both of which lie on the extension of the center line of the die 17 to form a straight line altogether. The die 17 is provided on the upper surface with a groove-like receptacle 22 which fits an undermentioned cutter blade 29 in shape.

Figure 7:
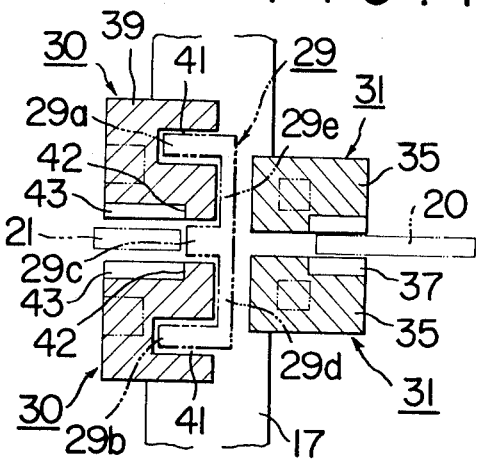
FIG. 7 is a cross sectional view of the apparatus of FIG. 5 along the line VII—VII.
Figure 8:
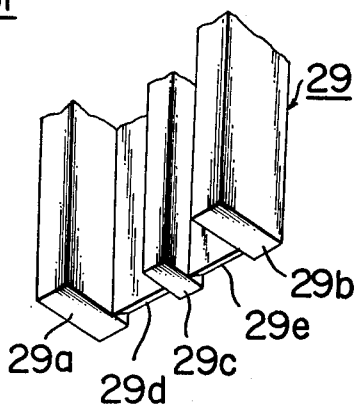
FIG. 8 is a perspective view of the cutter blade of the apparatus of FIG. 5.

The above-mentioned punch unit 14 is provided with a cylinder 24 fixed to the above-mentioned base 15 through a frame 23 and a punch plate 25 securedly fixed to the piston rod 24*a* of the cylinder 24. On the lower surface of the punch plate 25 are provided a pair of guide bushes 26, 26 which perform sliding movement relative to respective guide pins 27, 27 erected on the base 15 and inserted into the respective guide bushes 26, 26. On the lower surface of the punch plate 25 is fixedly provided a punch holder 28 which in turn serves to clamp the cutter blade 29, having a cross section, as shown in FIGS. 7 and 8, to match the cutting lines $L_1$ to $L_5$ in FIG. 2, being provided correspondingly with cutter sections 29*a*, 29*b*, 29*c* for cutting the reinforcement tape and cutter sections 29*d*, 29*e* for cutting the carrier tapes in an E-shaped integral arrangement.

At the rearward position and at the front position to the above-mentioned cutter blade 29 are provided a pair of rear pressers 30, 30 and a pair of front pressers 31, 31, respectively, in a symmetrical disposition relative to the center line of the die 17 positioned at the right and left sides of the linear protrusions 21 and 20, respectively. The front pressers 31, 31 are each composed of a pad holder 34 inserted with free vertical movement into a guide hole 32 in the punch holder 28 and having a hook protrusion 33 coming into engagement with the punch holder 28 at the top thereof, a rectangular pad 35 connected to the lowermost end of the pad holder 34 and a compressive spring 36 to exert a downward pressure on the pad holder 34. Each of the pads 35 has a goove-like cutting 37 on the lower surface thereof along the center line of the die 17, as is shown in FIGS. 4 and 7, where the row of the elements comes to fit the pad 35 when the pad 35 is lowered to press-hold the fastener chain at the position.

The lower surface of the pad 35 is at the height level slightly lower than the edge 29′ of the cutter blade 29 by a height difference H shown in FIG. 5 when the pad is in the pulled-up position not in contact with the fastener chain to be press-held therewith.

Similarly the rear pressers 30, 30 are each composed of a pad holder 38 inserted with free vertical movement into a guide hole 38′ in the punch holder 28, a pad 39 connected to the lowermost end of the pad holder 38 and a compressive spring 40 to exert a downward pressure on the pad holder 38. Each of the pads 39 is provided with a notch 41 at the front portion thereof through which the one of the cutter sections 29*a*, 29*b* can move up and down and also provided with an element-guide groove 43 with a stopper face 42 on the lower surface along the center line of the die 17.

The rear pressers 30 each have a step 44 on the rear surface of the pad holder 38 where the presser 30 is engaged with a stopper 45 to be held above the fastener chain while the stopper 45 is inserted into a holder 46 with free horizontal sliding. The stopper 45 is operated by a solenoid 47 through a linking mechanism which is composed of a plunger 47*a* of the solenoid, a link 48 connected to the plunger 47*a*, a first lever 50, pivoted on a pin 49 as a fulcrum, connected to the link 48 at one end, a stopper screw 51 at the other end of the first lever 50, a second lever 52 in contact with the stopper screw 51 at the rear end thereof and fixed to a rotatable shaft 54 at the other end thereof supported by a bearing 53 fixed to the upper surface of the punch plate 25; a third lever 55 fixed to the shaft 54 at the upper end thereof and extending downwardly through a hole 56 in the punch plate 25 and a pin 57 at the lowermost end of the third lever 55 and engaged with an engagement groove 45′ at the rear end of the above-mentioned stopper 45 while the second lever 54 is upwardly biased to rotate counterclockwise in FIG. 5 on the shaft 54 by a compressive spring 58 acting between the second lever 52, at around the middle part thereof, and the punch plate 25. The first lever 50 is connected to a tension spring 64 which exerts a pulling force on the first lever 50 to rotate it clockwise in FIG. 4 to return to its original position in readiness for the next actuation of the solenoid 47 when the solenoid 47 is deactivated.

The above-mentioned solenoid 47 is operated by a switching unit in front of the base 15 composed of a switch 59, a switching pin 60 to operate the switch 59 and a switching lever 61 to press down the switching pin 60. A switch 62 provided on the back surface of the base 15 serves to switch an electromagnetic valve (not shown in the figures) of the cylinder 24 and the switch 62 is turned on when cutting with the cutter blade 29 has been completed by being pressed by an operating member 63 descending with the cutter blade 29 and fixed to the lateral side of the punch plate 25 as shown in FIG. 4.

In the following, the process steps in the method by use of the above apparatus are described in sequence with reference to FIGS. 4, 5 and 9 to 15.

Figure 9:
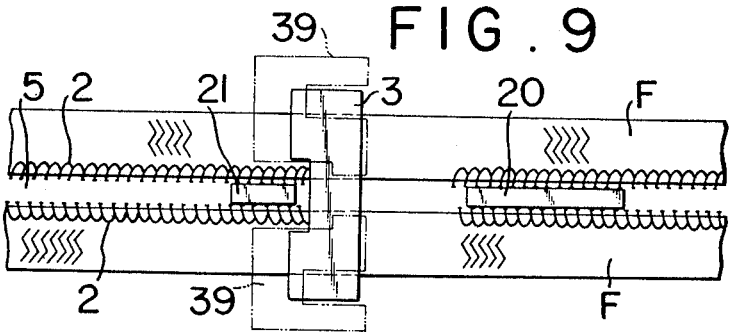
FIG. 9 to FIG. 15 are for illustrating the steps of fabrication in accordance with the inventive method.

A continuous length fastener chain A (as shown in FIG. 2) with reinforcement tapes 3 adhesively bonded to the individual space sections 4 is placed on the chain-guide plates 18, 19 and the die 17 along the center line of the die 17 in such a manner that the reinforcement tape 3 on a space section 4 is approximately above the die 17 and both of the fastener chains F, F are positioned with the gap 5 therebetween to fit the linear protrusions 20, 21 on the chain-guide plates 18, 19 as shown in FIG. 9. The next step is to push the switching lever 61 manually to turn on the switch 59 whereby the solenoid 47 is actuated so that the plunger 47*a* is pulled up, the first lever 50 rotates counterclockwise in FIG. 4 around the pin 49, the second lever 52 is pushed by the stopper screw 51 to rotate clockwise in FIG. 5 on the shaft 54, whereby the third lever 55 also rotates clockwise in FIG. 5, pulling the stopper 45 rearwardly by means of the engagement pin 57, resulting in disengagement of the stopper 45 from the step 44 of the pad holder 38, permitting the sudden downward movement of the rear pressers 30, which are under downward pressure by the compressive springs 40, so that the fastener chains F, F are press-held by the pads 39, 39 with a relatively small pressure. In this case, the rows of elements 2, 2 are received within the element-guide grooves 43, 43 provided on the lower surfaces of the pads 39, 39 as shown in FIG. 10.

When the stopper 45 has disengaged from the engagement step 44, the solenoid 47 is deactivated so that the stopper 45 is urged against the lateral surface of the pad holder 38 by the compressive force of the spring 58.

Figure 10:
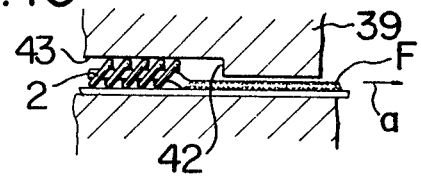
Figure 11:
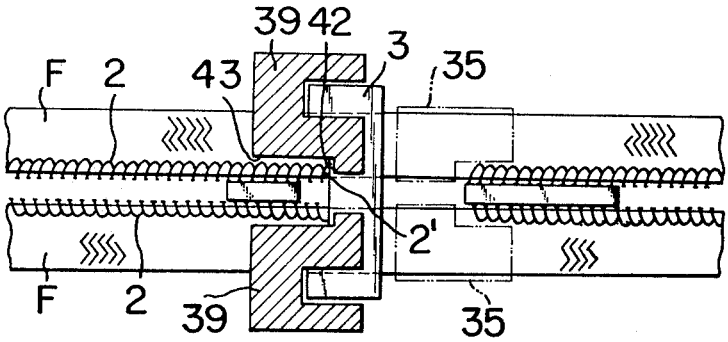
Figure 12:
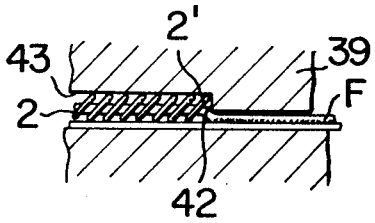

The next step is to pull the thus press-held fastener chain manually forwardly, i.e. in the rightward direction in FIG. 5 or in the direction of the arrow a in FIG. 10, by hand slightly until the terminals 2', 2' of the element rows 2, 2 come into contact with the stopper faces 42 of the elementguide grooves 43 where the fastener chains F, F are stopped at their exact positions as shown in FIGS. 11 and 12. During the movement of the fastener chains by manual pulling, the fastener chains are gently press-held by the pads 39 so that the fastener chains are under suitable tension to avoid distortion or creasing ensuring exact positioning.

Figure 13:
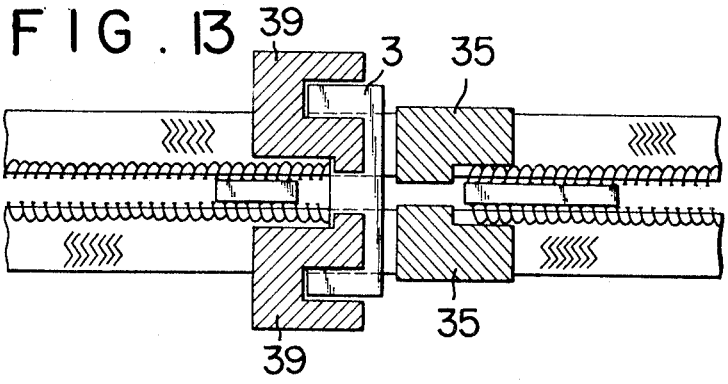
Figure 14:
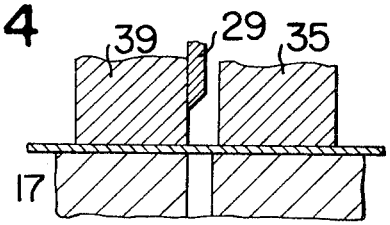
Figure 15:
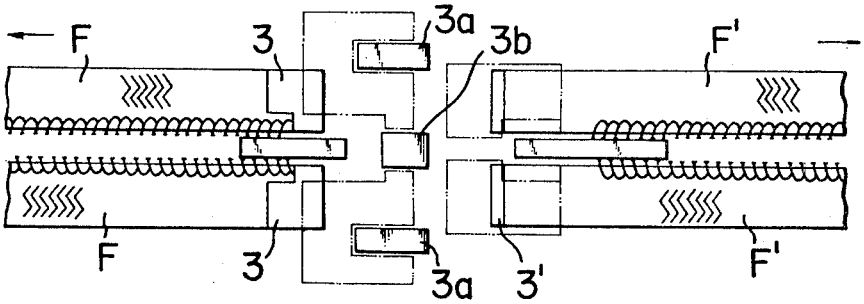

Then the cylinder 24 is operated by supplying air, for example, by operating a foot switch (not shown in the figures) below the base 15 so that the cutter blade 29, the punch plate 25 and the front pressers 31 are all lowered whereby the pads 35 first come to contact with the fastener chain to press-hold the fastener chain at the front side of the cutting line as shown in FIGS. 13 and 14 and then the cutter blade 29 is lowered to cut the fastener chain and the reinforcement tape along the cutting lines $L_1$ to $L_5$ simultaneously giving separated fastener chains F and F' bearing the reinforcement tapes at their respective ends, the extraneous portions 3*a*, 3*b* of the reinforcement tape 3 having been cut off. It is mentioned that of course the cutting along the main cutting line $L_1$ is performed by the cutter sections 29*d*, 29*e* and the cutting along the auxiliary cutting lines $L_2$ to $L_5$ is performed by the cutter sections 29*a*, 29*b*, 29*c*. Thus a single cutting movement of the cutter blade 29 gives a fastener chain F, F with the reinforcement tape 3 on the lower ear ends and another fastener chain F', F' with the reinforcement tape 3' on the upper ends as shown in FIG. 15.

When the cutting movement of the cutter blade 29 has been completed, the switch 62 is operated by the member 63 so that the cylinder 24 is switched to elevation and the cutter blade 29 begins to ascend with the press-holding of the fastener chain by the pads 35 of the front presser 31 being continued until the cutter blade 29 reaches a height where the height difference between the edge 29' of the cutter blade 29 and the lower surface of the pads 35 becomes equal to or larger than H shown in FIG. 5 in prevention of lifting of the fastener chain by the upward movement of the cutter blade 29 apart from the die 17. Further elevation of the cutter blade 29 brings the engagement step 44 to the height of the stopper 45 where the stopper 45 and the engagement step 44 come into engagement with each other by virtue of the compressive spring 58. The above description is for one cycle of the operational movement of the apparatus with which the fabrication of fastener chains with reinforcement tapes can be performed efficiently by repeating the above cycle.

As described above in detail, the illustrated method and apparatus ensure a high working efficiency in the fabrication of fastener chains with reinforcement tapes since cutting of the fastener chains per se and cutting off of the extraneous portions of the reinforcement tapes can be performed simultaneously and, moreover, give an advantage of well-finished products by exact cutting along the correct cutting lines since the fastener chain is positioned to the correct cutting position as being gently press-held with the pressers at one side of the main cutting line followed by cutting while being press-held also at the other side of the main cutting line with another pair of pressers so that the fastener chain is under tension in the section between two pairs of pressers avoiding slackening or creasing of the fastener chain which otherwise might lead to inexactness of cutting.

We claim:

1. An apparatus for the fabrication of a fastener chain with reinforcement tapes comprising:

(1) a die, (2) two chain guide plates positioned at the front and at the rear of the die, respectively, and each having a line protrusion on the upper surface thereof, (3) a cutter positioned above the die with movability in the vertical direction, (4) a pair of rear pressers positioned at the rear of the cutter and urged downwardly by a spring while suspendedly held by an engagement means comprised of a stopper movable to become engaged with and disengaged from the rear pressers for permitting sudden downward movement of the rear pressers and a means to drive the stopper, and (5) a pair of front pressers positioned at the front of the cutter with movability in the vertical direction and urged downwardly by a spring.

2. The apparatus as claimed in claim 1 wherein the lower surface of the front pressers is positioned at a level lower than the lower edge of the blade of the cutter.

3. The apparatus as claimed in claim 2 wherein an element guide groove with a stopper face to engage the terminal of an element row is formed on the lower surface of each of the rear pressers.

* * * * *